US011400335B2

(12) United States Patent
Nachowicz

(10) Patent No.: US 11,400,335 B2
(45) Date of Patent: Aug. 2, 2022

(54) BARBELL STRAP

(71) Applicant: Jason Paul Nachowicz, Elgin, IL (US)

(72) Inventor: Jason Paul Nachowicz, Elgin, IL (US)

( * ) Notice: Subject to any disclaimer, the term of this patent is extended or adjusted under 35 U.S.C. 154(b) by 0 days.

(21) Appl. No.: 16/949,737

(22) Filed: Nov. 12, 2020

(65) Prior Publication Data

US 2021/0220692 A1 Jul. 22, 2021

Related U.S. Application Data

(60) Provisional application No. 62/961,729, filed on Jan. 16, 2020.

(51) Int. Cl.
*A63B 21/078* (2006.01)
*A63B 71/00* (2006.01)
*A63B 21/072* (2006.01)

(52) U.S. Cl.
CPC ..... *A63B 21/0783* (2015.10); *A63B 21/0724* (2013.01); *A63B 71/0054* (2013.01); *A63B 2071/0081* (2013.01)

(58) Field of Classification Search
CPC . A63B 21/04; A63B 21/0407; A63B 21/0414; A63B 21/0442; A63B 21/072; A63B 21/0728; A63B 21/0783; A63B 21/0724; A63B 21/4001; A63B 21/4019; A63B 21/4021; A63B 71/00; A63B 71/0054; A63B 2225/09; A63B 2071/0081
See application file for complete search history.

(56) References Cited

U.S. PATENT DOCUMENTS 4,478,414 A * 10/1984 Molloy ..... A63B 21/1609 482/123
5,518,486 A * 5/1996 Sheeler ..... A63B 21/0004 482/131
7,662,073 B1 * 2/2010 Baldwin ..... A63B 21/4021 482/92
2015/0057133 A1 * 2/2015 Nguyen ..... A63B 21/4021 482/93
2016/0023037 A1 * 1/2016 Schiek ..... A63B 21/0783 482/92
2016/0023051 A1 * 1/2016 Lauener ..... A63B 7/00 482/143
2018/0290007 A1 * 10/2018 Vorozilchak ..... A63B 21/0726

OTHER PUBLICATIONS

TrainFTW, Setting Up a Barbell in a Rack For Bar Muscle Ups [YouTube], Published Aug. 31, 2018, Retrieved from the Internet <URL: https://www.youtube.com/watch?v=tsjPulF8UeM> (Year: 2018).*

* cited by examiner

*Primary Examiner* — Nyca T Nguyen
*Assistant Examiner* — Zachary T Moore
(74) *Attorney, Agent, or Firm* — Dunlap Bennett & Ludwig, PLLC; Brendan E. Squire

(57) ABSTRACT

A barbell belt to secure a barbell to an exercise apparatus in order to retain the barbell in a stationary position is disclosed. The barbell belt includes a strap having a first side and a second side. A loop is formed by overlying the first side of the first end over the second side of the first end. A fastener to secures the strap in the loop. A running end of the strap extends longitudinally from the fastener. A buckle is attached to the strap proximal the fastener. The barbell belt allows an athlete to secure a barbell to an exercise apparatus so that the athlete can perform stationary bar exercises on the barbell and the barbell will be quickly and securely retained on the exercise apparatus.

2 Claims, 3 Drawing Sheets

BARBELL STRAP

CROSS-REFERENCE TO RELATED APPLICATION

This application claims the benefit of priority of U.S. provisional application No. 62/961,729, filed Jan. 16, 2020, the contents of which are herein incorporated by reference.

BACKGROUND OF THE INVENTION

The present invention relates to personal exercise equipment, and more particularly exercises performed on a barbell.

Attempting to practice gymnastics or weightlifting moves on a barbell in a rack is dangerous due to the risk of the bar becoming dislodged the j-hooks securing the barbell to the rack. The current problem with securing a steel barbell into a rack is that the general practice of using rubber exercise bands as the means of fastening the barbell places the athlete in danger. Should the rubber band snap and the bar to fall upon the user or cause the user to fall. Additionally, the time to adjust and secure a bar using the traditional rubber band method takes well over two minutes and over time destroys the bands, which were not designed for this purpose.

Other securing devices will eventually tear, causing the bar to fall and seriously injure the athlete. They are also burdensome to work with as bands were not intended to secure a bar to a rack.

As can be seen, there is a need for an improved barbell strap that quickly and reliably secures the barbell to the exercise rack.

SUMMARY OF THE INVENTION

In one aspect of the present invention, 1*a* barbell belt is disclosed to secure a barbell to an exercise apparatus to retain the barbell in a stationary position. The barbell belt includes a strap having a first side and a second side, a first end, a second end. A loop is formed by overlying the first side of the first end over the second side of the first end. A fastener secures the strap in the loop. A running end of the strap extends longitudinally from the fastener. A buckle is attached to the strap proximal the fastener.

In some embodiments, the loop is dimensioned to fit around a collar of the barbell. The loop may have a circumference is at least 24 centimeters.

In some embodiments, the strap includes a first strap forming the loop and a second strap forming the running end of the strap. The first strap and the second strap are joined by the fastener. The fastener may be a stitching.

In other aspects of the invention, a method of securing a barbell to an exercise apparatus to retain the barbell in a stationary position on the exercise apparatus is disclosed. The method includes suspending the barbell on a support hook carried on an upright member of the exercise apparatus, the barbell having a collar at opposed ends of the barbell. A barbell belt having a loop at a first end of an elongate strap, a buckle proximal to a juncture of the loop is provided. The loop is suspended on the barbell inboard of the collar.

A running end of the barbell belt is then routed about the upright member, such that with a tension applied the barbell is urged in contact with the support hook.

The running end of the barbell belt may then be routed about a bar element of the barbell and carried forward to the buckle. The running end of the barbell belt is threaded through the buckle. The barbell belt may then be cinched about the bar element of the barbell and the upright member.

These and other features, aspects and advantages of the present invention will become better understood with reference to the following drawings, description and claims.

DETAILED DESCRIPTION

The following detailed description is of the best currently contemplated modes of carrying out exemplary embodiments of the invention. The description is not to be taken in a limiting sense, but is made merely for the purpose of illustrating the general principles of the invention.

Broadly, embodiments of the present invention provides an improved barbell strap that that quickly and reliably secures a barbell to an exercise rack. The athlete is then able to hang or pull on the barbell without danger of the bar becoming unsecured and has the accessibility to quickly adjust the bar's height. The barbell strap, or Barbelt, is a heavy duty cotton or nylon webbing that is resistant to tearing and because of its design, will secure the bar to a rack in under 15 seconds.

Figure 1:
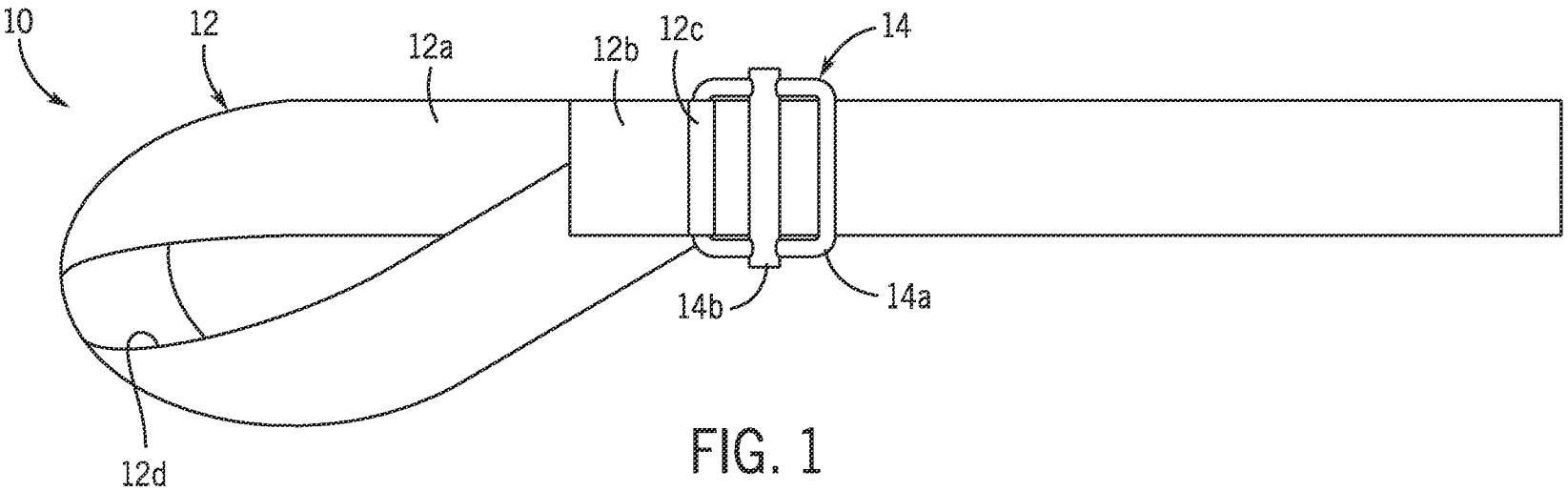
FIG. 1 is a front elevation view of the barbell strap.
Figure 2:
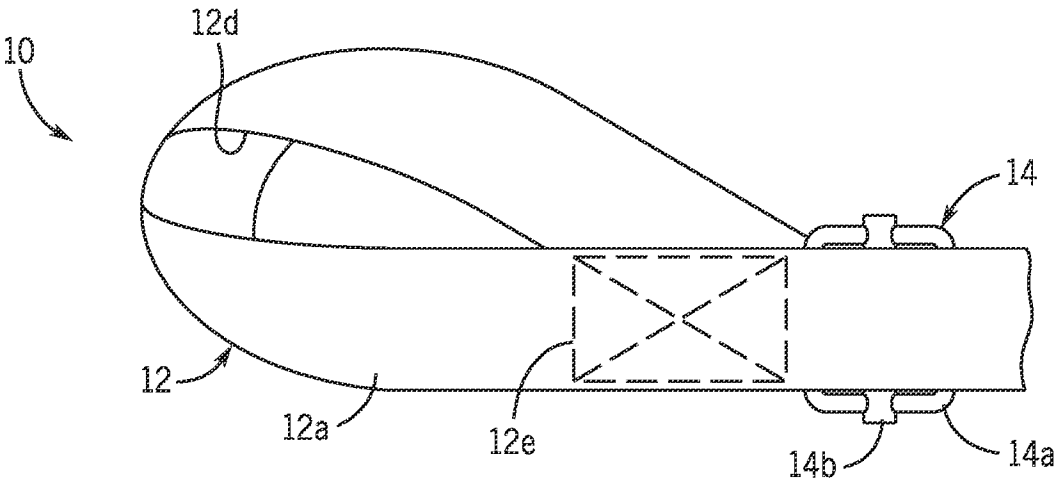
FIG. 2 is a rear elevation view of the barbell strap.

As seen in reference to the drawings of FIGS. 1 and 2, the barbelt 10 of the present invention includes a strap 12 formed of a length of a cord or a webbing 12, such as nylon, or other durable woven material. The strap 12 includes a first side surface and a second side surface, a first end, and a second end. As will be appreciated the strap 12 may be formed with a first strap element 12*a* and a second strap element 12*b*. A loop 12*d* is formed in the first strap element 12*a*, such that the first side surface is attached to the second side surface by a fastener 12*e*. In the non-limiting embodiment shown, the fastener 12*e* is a stitching. The loop 12*d* is dimensioned to fit around a collar 16*b* of a barbell 16. Preferably, the loop 12*d* is dimensioned to have approximately a 24 cm circumference, corresponding to the collar 16*b* of an Olympic sized barbell 16. As will be appreciated, a cylindrical sleeve may be substituted for the loop 14 and attached to the strap 12. The strap 12 may also include a friction enhancing surface, such as a plurality of rubber or silicone beads to enhance the grip around the bar to prevent the barbell from spinning.

A buckle 14 is secured to the strap 12 proximal to the juncture where the loop 12*d* is secured by the fastener 12*e*. In the non-limiting embodiment shown, the buckle 14 may be secured by joining the second strap element 12*b* to the first strap element 12*a* about a first bail 14*a* of the buckle 14 and secured with the fastener 12*e*. Preferably, the second strap element 12*b* is attached to the first strap element 12*a* so that it is longitudinally aligned with at least one leg of the loop 12*d*.

The buckle 14 is aligned along the longitudinal length of the second strap 12*b* or at the base of the loop is a buckle mechanism 14 that allows a running end of the strap 12 to be double backed and secured by the buckle 14 so as to not become loose. In the non-limiting embodiment shown, a second bail 14*a* is disposed opposite the loop 12*d* with a center post 14*b* disposed between the first bail 14*a* and the second bail 14*b*. The running end of the strap 12 is secured by threading through the second bail 14*a* and the center post 14*b*, permitting cinching of the strap 12 about the exercise apparatus 18 and the barbell 16. Accordingly, the strap 12 should have a longitudinal length to permit it to wrap around an upright support 18*b* of the exercise apparatus 18, the barbell 16, and double back to the buckle 14 for securement of the barbell 16 to the rack.

Figure 3:
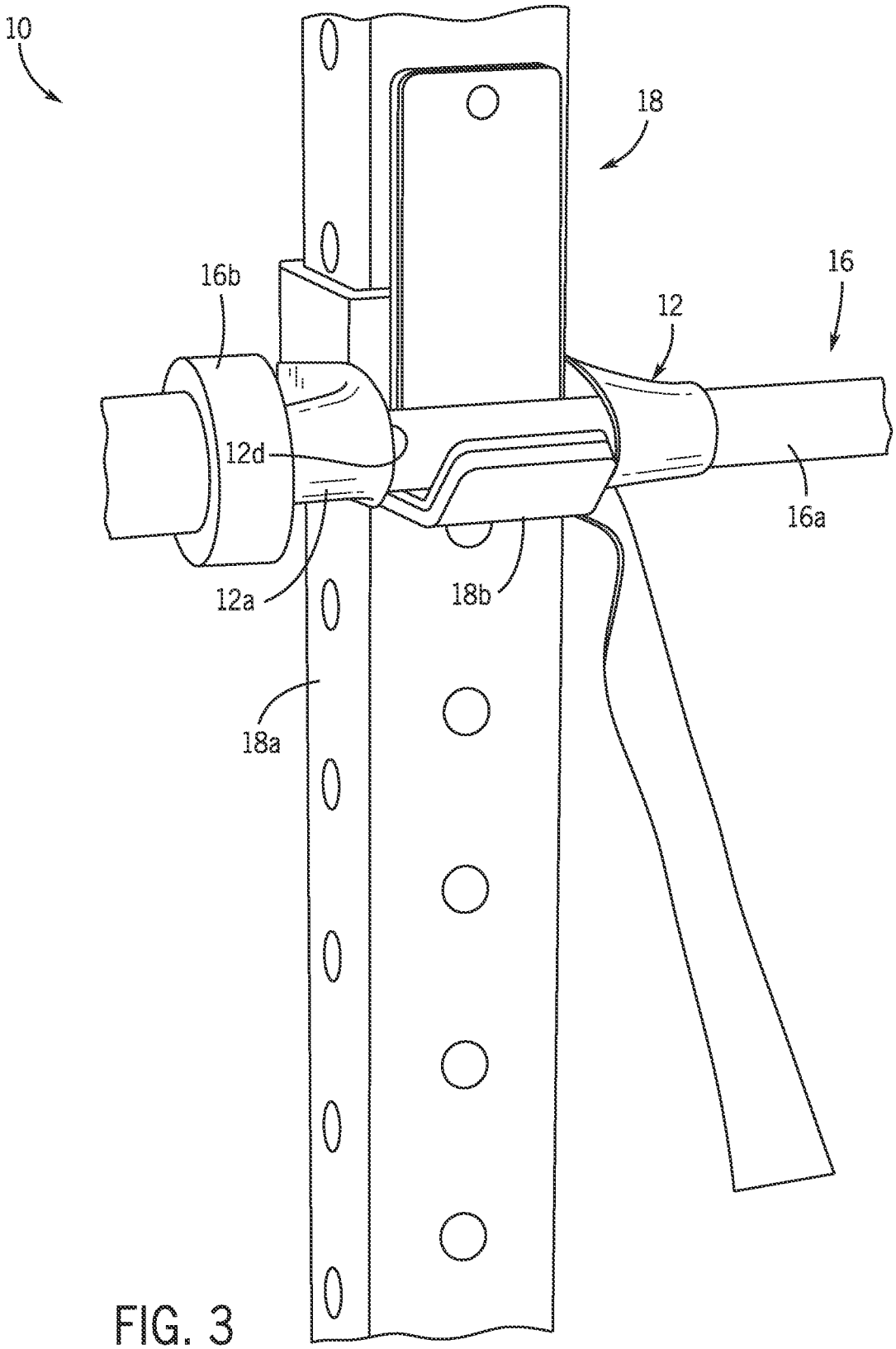
FIG. 3 is a front perspective view of the barbell strap in use.
Figure 4:
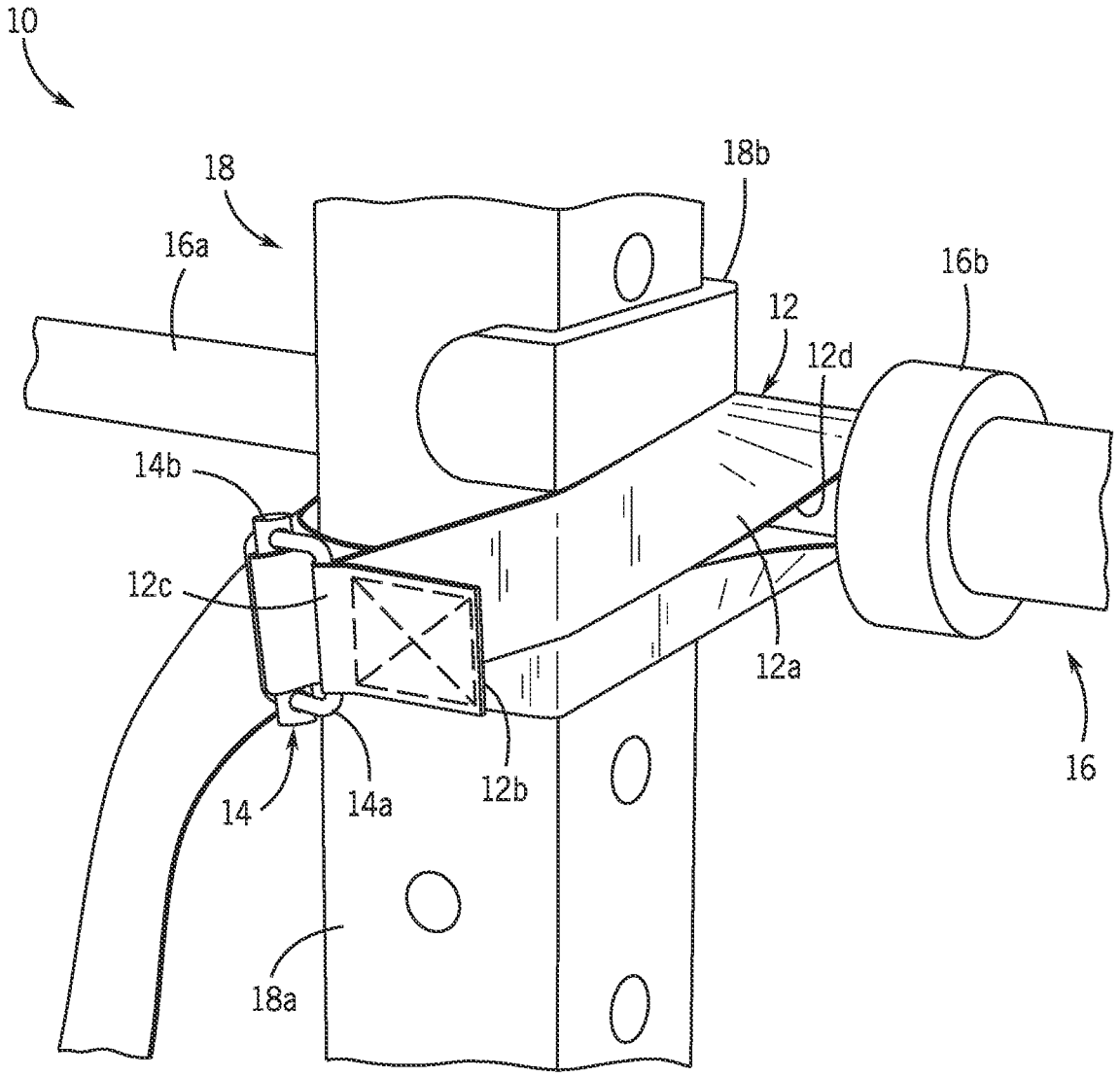
FIG. 4 is a rear perspective view of the barbell strap in use.

As seen in reference to FIGS. 3 and 4, the barbell strap 10 is utilized to secure a barbell 16 to an exercise apparatus 18. The exercise apparatus 16 has a plurality of upright frame members 18*a*. A hook mechanism 18*b* is attached to the upright frame members 18*a*. The hook mechanism 18*b* is typically utilized to support the barbell 16 so that the athlete may perform a barbell exercise by movement of the barbell 16 with a plurality of weight plates suspended to the barbell 16 and carried on the ends of the barbell 16 outboard from the collars 16*b*. With the barbell strap 10 of the present invention, the bar element 16*a*, disposed between the collars 16*b* may be secured in a stationary condition to the exercise apparatus 18 so that the bar element 16*a* may be utilized to perform exercise movements about the barbell 16, such as pull-ups. Because the barbell 16 is securely mounted to the exercise apparatus, the athlete may also perform gymnastic type movements involving swinging of their body about the stationary barbell 16.

A method of using the exercise strap 10, may include the following steps:

1) Place the loop 12*d* around the collar 16*b* of a barbell 16 supported on J-hooks 18*b* of the exercise apparatus 18.
2) Take the running end of the strap 12 around the back of the power rack upright support 18*a*, and around the bar element 16*a* of the barbell 16 carried in the J-hook 18*b*. Return the running end of the strap 18 along the upright member 18*a* to the buckle 14.
3) Before threading the running end of the strap 18 through the buckle 14, remove all slack from the strap 12 so it is tight around the barbell 16, pulling the barbell into the J-hook 18*b* on the upright member 18*a*.
4) Feed the running end of the strap 12 through the second bail 14*a* of the buckle 14, around the center post 14*b* of the buckle and back out of second bail 14*a* the buckle 14 and cinching the running end of the strap 12 in the buckle 14 to prevent the strap 12 from sliding.
5) Repeat this process with a second belt on the opposite side of the bar.

It should be understood, of course, that the foregoing relates to exemplary embodiments of the invention and that modifications may be made without departing from the spirit and scope of the invention as set forth in the following claims.

What is claimed is:

1. A method of securing a barbell to an exercise apparatus to retain the barbell in a stationary position on the exercise apparatus, comprising:

suspending the barbell on a support hook carried on an upright member of the exercise apparatus, the barbell having a collar at opposed ends of the barbell;

providing a barbell belt having a loop at a first end of an elongate strap, a buckle proximal to a juncture of the loop;

suspending the loop on the barbell inboard of the collar routing a running end of the barbell belt about the upright member, such that with a tension applied the barbell is urged in contact with the support hook;

routing the running end of the barbell belt about a bar element of the barbell; and threading the running end of the barbell belt through the buckle.

2. The method of claim 1, further comprising:

cinching the barbell belt about the bar element of the barbell and the upright member.

* * * * *